US006189972B1

(12) United States Patent
Chu et al.

(10) Patent No.: US 6,189,972 B1
(45) Date of Patent: Feb. 20, 2001

(54) LUMBAR SUPPORT ADJUSTMENT MECHANISM

(75) Inventors: Zooey Chu, Grand Rapids, MI (US); Harald Wurl, Kleinsendelbach; Hermann Bock, Pyrbaum, both of (DE)

(73) Assignee: Teknion Furniture Systems Inc. (CA)

( * ) Notice: Under 35 U.S.C. 154(b), the term of this patent shall be extended for 0 days.

(21) Appl. No.: 09/092,542

(22) Filed: Jun. 5, 1998

(51) Int. Cl.[7] ..... A47C 3/025
(52) U.S. Cl. ..... 297/284.4; 297/284.8
(58) Field of Search ..... 297/284.7, 284.8, 297/284.4

(56) References Cited

U.S. PATENT DOCUMENTS

| | | | | |
|---|---|---|---|---|
| D. 358,515 | | 5/1995 | Adat et al. . | |
| 1,001,312 | * | 8/1911 | Sebring | 297/284.7 |
| 1,264,265 | * | 4/1918 | Brusius | 297/284.8 X |
| 2,756,809 | * | 7/1956 | Endresen | 297/284.8 X |
| 3,463,544 | | 8/1969 | Froelich . | |
| 3,880,463 | | 4/1975 | Shephard et al. . | |
| 3,948,558 | * | 4/1976 | Obermeier et al. | 297/284.4 |
| 4,156,544 | * | 5/1979 | Swenson et al. | 297/284.7 X |
| 4,295,681 | | 10/1981 | Gregory . | |
| 4,354,709 | | 10/1982 | Schuster . | |
| 4,452,485 | | 6/1984 | Schuster . | |
| 4,465,317 | | 8/1984 | Schwarz . | |
| 4,601,514 | * | 7/1986 | Meiller | 297/284.4 |
| 4,632,454 | * | 12/1986 | Naert | 297/284.7 X |
| 4,647,066 | * | 3/1987 | Walton | 297/284.8 X |
| 4,730,871 | | 3/1988 | Sheldon . | |
| 4,893,872 | * | 1/1990 | Sugai | 297/284.8 |
| 5,050,930 | | 9/1991 | Schuster et al. . | |
| 5,174,526 | | 12/1992 | Kanigowski . | |
| 5,217,278 | | 6/1993 | Harrison et al. . | |
| 5,335,965 | | 8/1994 | Sessini . | |
| 5,344,211 | | 9/1994 | Adat et al. . | |
| 5,397,164 | | 3/1995 | Schuster et al. . | |
| 5,449,219 | | 9/1995 | Hay et al. . | |
| 5,452,868 | | 9/1995 | Kanigowski . | |
| 5,474,358 | | 12/1995 | Maeyaert . | |
| 5,498,063 | | 3/1996 | Schuster et al. . | |
| 5,553,917 | | 9/1996 | Adat et al. . | |
| 5,553,919 | | 9/1996 | Dennis . | |
| 5,567,010 | | 10/1996 | Sparks . | |
| 5,567,011 | | 10/1996 | Sessini . | |
| 5,624,158 | | 4/1997 | Adat et al. . | |
| 5,626,390 | | 5/1997 | Schuster et al. . | |
| 5,641,205 | | 6/1997 | Schmidt . | |
| 5,664,841 | | 9/1997 | Dal Monte . | |
| 5,823,620 | * | 10/1998 | Le Caz | 297/284.4 |
| 5,913,569 | * | 6/1999 | Klingler | 297/284.4 |
| 6,013,040 | * | 1/2000 | Morgenstern et al. | 297/284.4 X |

FOREIGN PATENT DOCUMENTS

| | | | | |
|---|---|---|---|---|
| 557421 | * | 5/1957 | (BE) | 297/284.8 |
| 1113192 | | 11/1981 | (CA) . | |
| 1125159 | | 6/1982 | (CA) . | |
| 1234040 | | 3/1988 | (CA) . | |
| 1235994 | | 5/1988 | (CA) . | |
| 2059537 | | 2/1991 | (CA) . | |
| 2075383 | | 9/1991 | (CA) . | |
| 1302858 | | 6/1992 | (CA) . | |
| 1309009 | | 10/1992 | (CA) . | |
| 2144860 | | 4/1994 | (CA) . | |

(List continued on next page.)

*Primary Examiner*—Anthony D. Barfield
(74) *Attorney, Agent, or Firm*—Laff, Whitesel & Saret, Ltd.

(57) ABSTRACT

A chair back comprises a rear surface, a front surface spaced from the rear surface and a side extending between the front and rear surfaces; a lumbar support member positioned between the front and rear surfaces and mounted for vertical movement with respect to the chair back and for forward movement with respect to the front surface; a first control member positioned on the rear surface of the chair back for adjusting the forward movement of the lumbar support member; and, a second control member positioned adjacent one of the sides of the chair back for adjusting the vertical height of the lumbar support member.

6 Claims, 8 Drawing Sheets

FOREIGN PATENT DOCUMENTS

| | | | | |
|---|---|---|---|---|
| 2165436 | | 1/1995 | (CA) . | |
| 2120456 | | 2/1995 | (CA) . | |
| 2183864 | | 8/1995 | (CA) . | |
| 2189347 | | 11/1995 | (CA) . | |
| 2197313 | | 2/1996 | (CA) . | |
| 2174419 | | 3/1996 | (CA) . | |
| 2181776 | | 1/1998 | (CA) . | |
| 3336349 | * | 4/1985 | (DE) | 297/284.4 |
| 0 700 653 A3 | | 3/1996 | (EP) . | |
| 0849798 | * | 9/1960 | (GB) | 297/284.4 |
| 2035792 | * | 6/1980 | (GB) | 297/284.4 |

* cited by examiner 74
20
70
25
24
27
23
76
23

FIG. 5. A-A
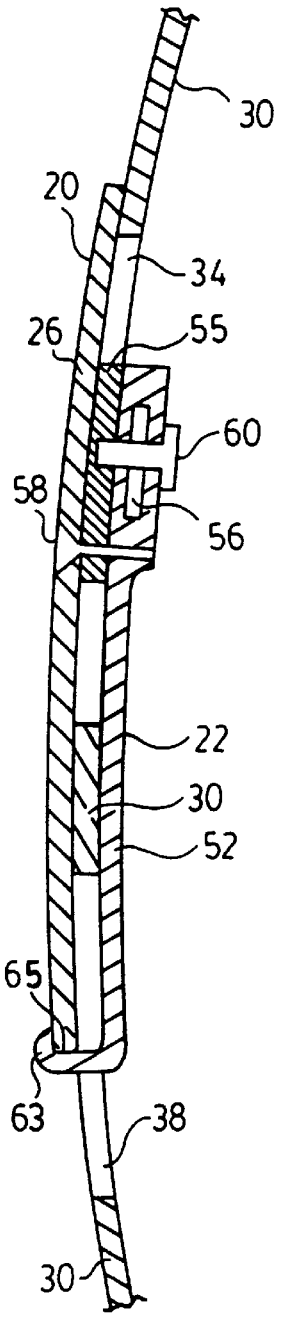
FIG. 6. B-B
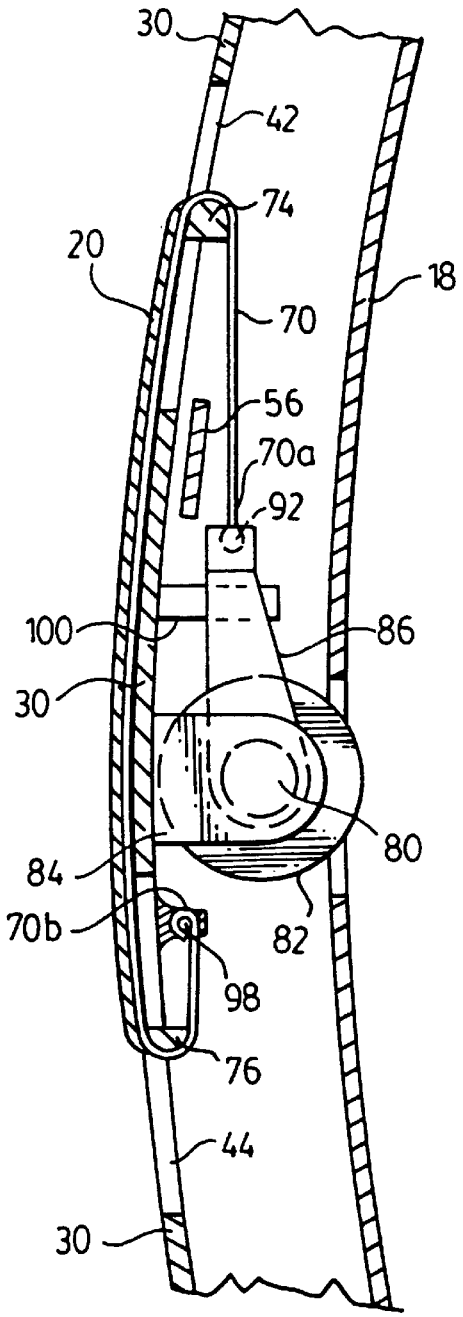

LUMBAR SUPPORT ADJUSTMENT MECHANISM

FIELD OF THE INVENTION

The present invention relates to an adjustable back or lumbar support for a seat. In particular the present invention relates to a back support having means for adjusting both the amount of lumbar support and the vertical position of the lumbar support.

BACKGROUND OF THE INVENTION

Lumbar supports exist in various forms to support the lumbar region of the human spine. Many of these prior art designs include a support which extends outwardly or curves outwardly to produce support against an appropriate position of the back. While prior art designs for adjusting the horizontal position of a lumbar support in this manner are known, these mechanisms typically include a large number of parts and are difficult, time-consuming, and costly to manufacture.

In addition, while a number of designs do provide for the horizontal adjustment of a back support, many of these do not include means for adjusting the vertical position of the support, thus reducing the available range of support positions and the potential for users of different shapes and sizes to use the seat. While prior art designs for adjusting both the horizontal and vertical positions of a lumbar support are known, these mechanisms are again complex and expensive to manufacture. More importantly it is generally desirable to minimize the thickness and size of the seat back, particularly with respect to any horizontal adjustment mechanism; something which complex and intricate lumbar support mechanisms do not generally permit.

For instance, U.S. Pat. No. 4,295,681 to Gregory shows a lumbar support device having two control means; one for adjusting the outward movement of the lumbar support and the other for adjusting the height of the lumbar support. Gregory uses a relatively large and complex mechanism consisting of a pair of link members and trunnions located on a threaded adjustment nut, one of which is on a shaft having a right hand thread, and the other is on a shaft having a left hand thread.

In Barley, U.S. Pat. No. 4,313,637, the lumbar support mechanism is positioned between spaced pairs of support arms. The respective arms of each pair are connected to define levers which adjust the amount of lumbar support which is provided.

Zacharkow, in U.S. Pat. No. 4,981,325, discloses a chair back having an upper back support member and a lower back support member. The lumbar support mechanism uses arms that extend from a threaded rod and are pivotally connected to the cushion which provides the lumbar support. The means for controlling the tilt of the lumbar support cushion is provided between the end of the arm and the cushion.

Sessini, U.S. Pat. Nos. 5,335,965 and 5,567,011, discloses a horizontally and vertically adjustable lumbar support device which utilizes a curved elastic plate and two vertically disposed threaded rods. The distal end of each rod in non-rotatably connected to one end of the curved elastic plate while the inner end of each rod is threadedly received in cylindrical scroll. The control is positioned an the side of the seat back and is connected to the lumbar support by multiple linkages. The support is adjusted vertically on a pair of vertical guides by means of control mechanism which includes a cord.

All of these support mechanisms require relatively large and complex mechanisms to enable adjustment of the amount of lumbar support which is provided by the device. Simplicity, reliability, and durability of design are also especially important since the lumbar adjustment mechanisms are generally located, for the most part, inside the upholstered seat back of the chair, and repairs are often difficult if not impossible to make.

Sheldon, U.S. Pat. No. 4,730,871, discloses a device which includes a vertical track and a guide made of spring steel which is mounted to be movable up and down in the track. The guide has a central portion spaced from the track to which the lumbar support member is attached. A screw member extends through the track to the lumbar support member. Rotation of the screw member allows the lumbar support member to be loosened to move vertically in the track and also causes the lumbar support member to be drawn rearwardly or pushed forwardly. While Sheldon discloses a simpler device, one problem with this mechanism is that a single control is used to adjust the vertical and horizontal adjustment of the lumbar support. Thus, the setting of the position and the amount of lumbar support are not independent. For example, when adjusting the height of the lumbar support, the amount of lumbar support may be affected.

SUMMARY OF THE INVENTION

In accordance with the instant invention, there is provided a chair back comprising a rear surface, a front surface spaced from the rear surface and a side extending between the front and rear surfaces; a lumbar support member positioned between the front and rear surfaces and mounted for vertical movement with respect to the chair back and for forward movement with respect to the front surface; a first control member positioned on the rear surface of the chair back for adjusting the forward movement of the lumbar support member; and, a second control member positioned adjacent one of the sides of the chair back for adjusting the vertical height of the lumbar support member.

One advantage of the instant invention is that by providing independent controls for the height adjustment and the amount of support provided by the lumbar support member, the controls and their positioning may be simplified. For example, it is difficult to quickly and correctly position the height of the lumbar support member while not seated in a chair. By positioning the height adjustment control on the side of the back rest, the user may easily adjust the height of the lumbar support member to suit their physiology.

Further, by providing a control on each side of the chair back, the control mechanism may be easily actuated by both right handed and left handed individuals.

By positioning the control to adjust the amount of support provided by the lumbar support in the center of the back rest, the control mechanism may be simplified, thus simplifying the manufacture of the device and, by reducing the number of linkages involved, increasing its reliability.

In one embodiment, a second control member may be positioned adjacent each side of the chair back.

In another embodiment, the side has a longitudinally extending opening and the second control member extends through the opening to the lumbar support member and travels along the opening as the height of the lumbar support member is adjusted.

In another embodiment, the lumbar support member is mounted on a track and is longitudinally moveable thereon to adjust the position of the lumbar support member with respect to the chair back. The track has first engagement members and the lumbar support member has a second engagement member which releasably engages the first engagement members as the lumbar support member moves longitudinally along the track.

In another embodiment, the lumbar support member is mounted on a track and is longitudinally moveable thereon to adjust the position of the lumbar support member with respect to the chair back and the lumbar support member has a second engagement member which frictionally engages the track to releasably engage the track as the lumbar support member moves longitudinally along the track.

In another embodiment, the lumbar support member is mounted on a track and is longitudinally moveable thereon to adjust the position of the lumbar support member with respect to the chair back. The lumbar support member has a runner which travels in the track and at least a portion of the track has a thickness less than the thickness of the runner to frictionally engage the runner to hold the lumbar support member in position with respect to the chair back.

In another embodiment, the lumbar support member is mounted on a track and is longitudinally moveable thereon to adjust the position of the lumbar support member with respect to the chair back. The lumbar support member has a runner which travels in the track and the track has alternating portions which vary in thickness. A plurality of the portions of the track have a thickness less than the thickness of the runner to frictionally engage the runner to hold the lumbar support member in position with respect to the chair back and a plurality of the portions of the track have a thickness greater than the thickness of the runner to permit the runner to travel freely therein.

In another embodiment, the lumbar support member includes a a compressible member and an adjustable member for applying a compressive force to the compressible member, the compressible member extending forwardly when compressed by the adjustable member.

In another embodiment, the lumbar support member includes a flexible panel and an adjustable member. The flexible panel has an upper end and a lower end and the adjustable member engages the upper and lower ends of the flexible panel and extends rearwardly of the flexible panel whereby the flexible panel bows forwarding when compressed by the adjustable member.

In another embodiment, the lumbar support member includes a flexible panel, a flexible member and a frame member. The flexible panel has an upper end and a lower end and one of the upper and lower ends is mounted to be vertically fixed in position with respect to the frame member. The flexible member contacts the other of the upper and lower ends of the flexible panel and extends rearwardly of the flexible panel whereby the flexible panel bows forwarding when compressed by the flexible member. In this embodiment, the chair back may further comprise a rigid support member and the lumbar support member may further comprise an arm member pivotally mounted on the rigid support member. A first arm of the arm member is connected to the flexible member and a second arm extends to contact the first control member. The first control member includes a member mounted for transverse movement whereby transverse movement of the member in one direction causes the second arm to move transversely and the first arm to move vertically to compress and bow the flexible panel. The first control member may comprise a threaded member rotatably mounted on the rigid support member and a rotatable control knob rotatably mounted on the threaded member.

In another embodiment, the chair back further comprises a rigid support member and the lumbar adjustment member further comprises a threaded shaft rotatably mounted on the rigid support member for movement in the transverse direction about its longitudinal axis, a rotatable knob operable to move the shaft in the transverse direction, a pivoting member pivotally mounted to the rigid support member and having a first arm having a first end which abuts one end of the threaded shaft and a second arm having a first clamping member for receiving the first end of the flexible member, and a second clamping member attached to one of the lower end of the flexible panel and the rigid support member for receiving the second end of the flexible member.

In another embodiment, the lumbar support member comprises a flexible panel having first engagement members and a rigid member having second engagement members; and the chair back further comprises a rigid support member having a plurality of openings, the first and second engagement members passing through the openings to engage and fix the flexible panel in position with respect to the rigid member. In this embodiment, the chair back may further comprise first and second attachment members for fixedly attaching each transverse side of the flexible panel to the respective side of the rigid member the first and second attachment members passing through the openings in the rigid support member whereby the transverse sides of the flexible panel are fixed in position with respect to the rigid member and the portion of the flexible panel between the transverse sides of the flexible panel being free to bow forwardly.

In another embodiment, a height adjustment mechanism for a lumbar support for a seat back comprises a rigid support member for the seat back, the rigid support member having a longitudinally extending track, the lumbar support member mounted on a track and longitudinally moveable thereon to adjust the position of the lumbar support member with respect to the chair back, the track having first engagement members and the lumbar support member having a second engagement member which releasably engages the first engagement members as the lumbar support member moves longitudinally along the track.

In another embodiment, a lumbar adjustment mechanism for mounting in a seat back and adjusting the amount of support provided by a lumbar support comprises a rigid support member; a flexible panel having an upper end and a lower end; a flexible member mounted on the rigid support member and engaging at least one of the upper and lower ends of the flexible panel and extending rearwardly of the flexible panel; and, a tensioning mechanism mounted on the rigid support member whereby adjustment of the tensioning mechanism increases the tension on the flexible member and, as the tension in the flexible member increases, the flexible panel bows forwardly.

BRIEF DESCRIPTION OF THE DRAWINGS

These and other advantages of the instant invention will be more fully and completely understood in association with the following description of the preferred embodiment of the invention in which:

FIG. 5 is a sectional view along the lines A—A in FIG. 3;

FIG. 6 is a sectional view along the lines B—B in FIG. 3;

DETAILED DESCRIPTION OF THE INVENTION

Figure 1:
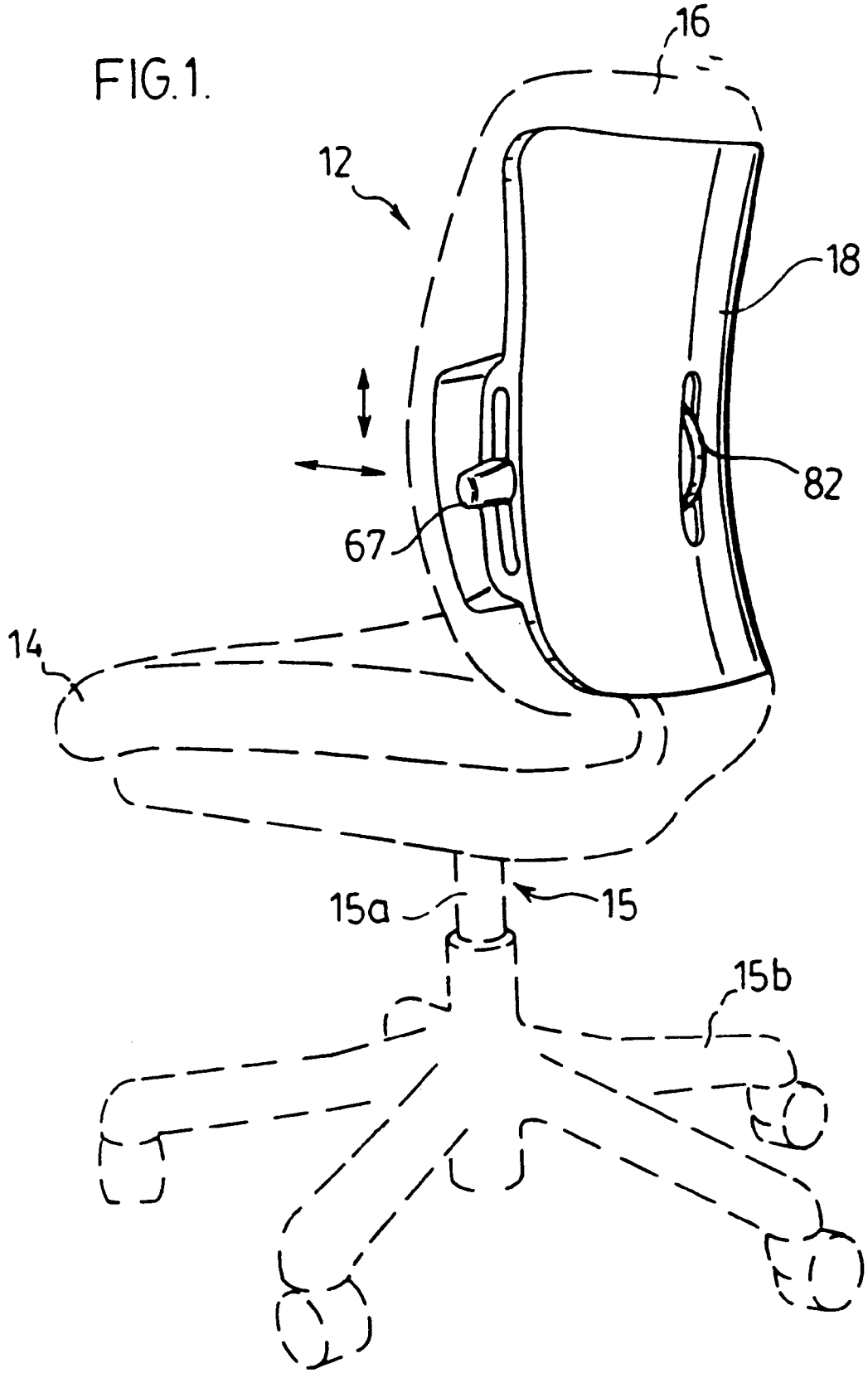
FIG. 1 shows a seat or chair having the lumbar support adjustment mechanism of the present invention integrated therein.

FIG. 1 shows a chair 12 with the adjustable lumbar support mechanism of the present invention integrated therein. The chair 12 comprises a seat portion 14 and a seat back portion 16, the seat back portion having a back cover 18. Seat back portion 16 may be of any shape or configuration known in the art.

Chair 12 may be a seating unit of any general type, shape or configuration. As shown in the preferred embodiment, chair 12 is an office chair or a task chair where a person may be seated for an extended period of time while working.

Seat portion 14 may be mounted on a support member 15 for supporting seat portion 14 at an elevated height. Preferably, the support member 15 comprises a longitudinally extending cylinder 15*a* (which, more preferably, is a pneumatic cylinder) having a wheeled base 15*b* as shown in FIG. 1.

The lumbar support mechanism forms part of the seat back portion 16 and, as explained in detail below, may be independently adjusted in both the horizontal direction (via control 82) and the vertical direction (via control 67) as indicated by the double-headed arrows in FIG. 1. The term vertical is used herein as a general direction reference and not an absolute term and is intended to be understood with reference to the plane passing upwardly through seat back portion 16. The term horizontal is used herein as a general direction reference and not an absolute term and is intended to be understood with reference to the plane transverse to the plane passing upwardly through seat back portion 16.

In one preferred embodiment, the lumbar support includes a mechanism to increase or decrease the amount of lumbar support which is provided. To this end, a flexible support 20 which expends outwardly under compression is provided. In another preferred embodiment, the lumbar support alternately includes, or may in addition include, a height adjustment mechanism. To this end, seat back 16 may be provided with a frame 30 having a track for vertical travel of the lumbar support device with respect to seat back 16.

Figure 2:
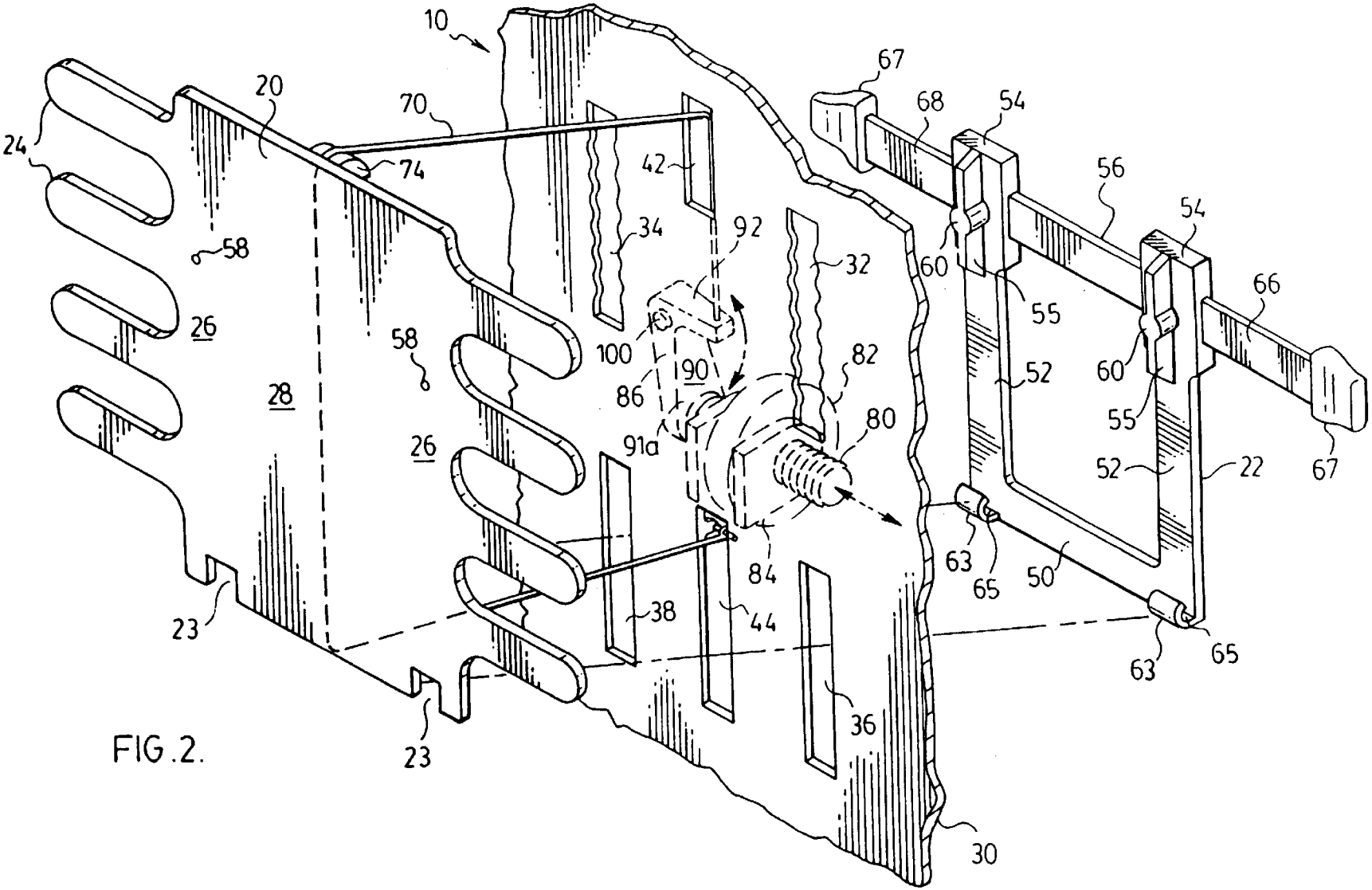
FIG. 2 shows an exploded view of the lumbar support adjustment mechanism of FIG. 1.
Figure 3:
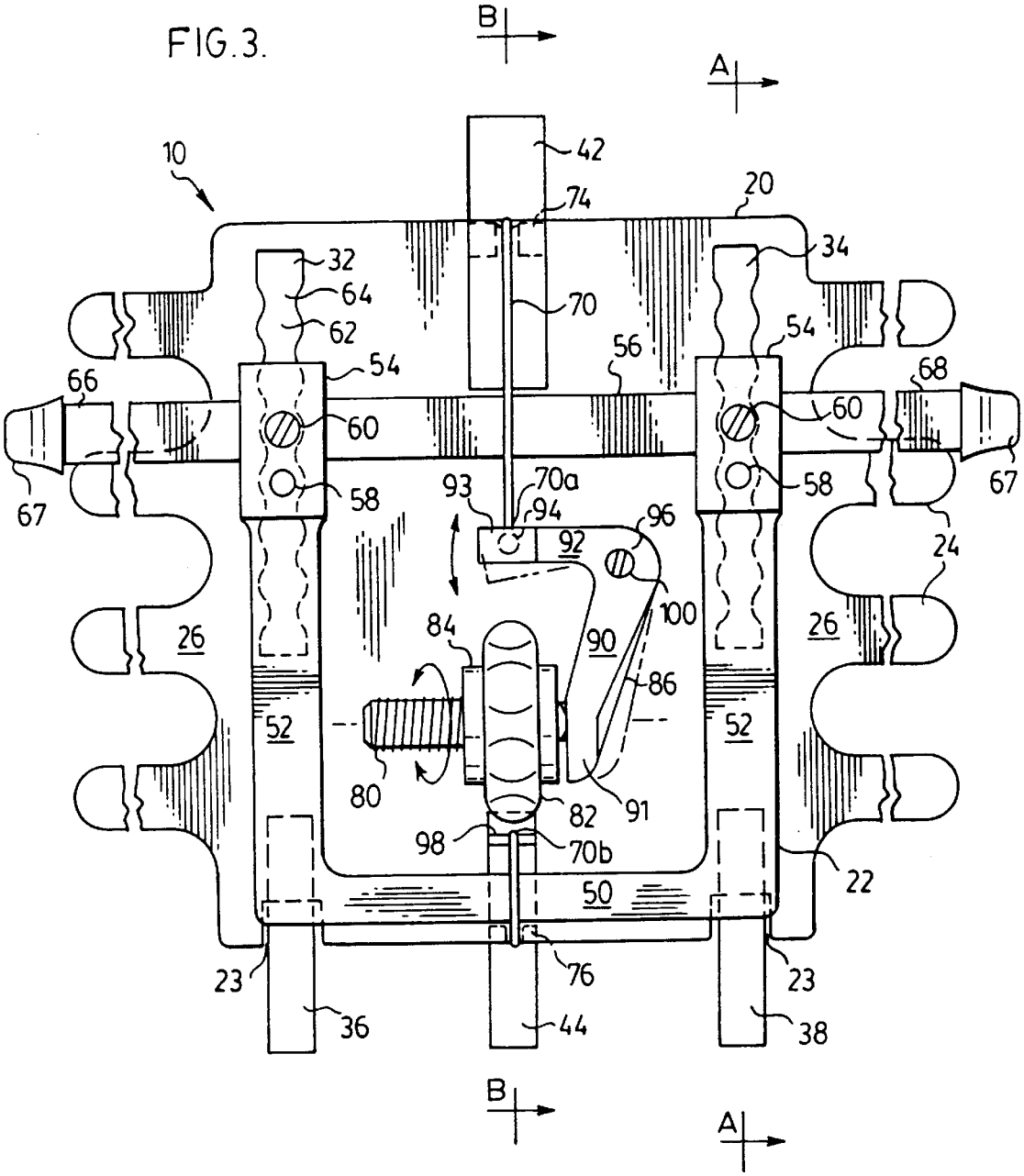
FIG. 3 is a back view of the lumbar support adjustment mechanism with the shroud of the back rest of FIG. 1 removed.

FIG. 2 shows a detailed exploded view of the adjustable lumbar support mechanism 10 of the invention which includes both adjustment means while FIG. 3 shows a detailed view of the rear of mechanism 10. The mechanism 10 comprises a flexible support member 20 mounted on a rigid support frame 22. If the lumbar support includes a height adjustment mechanism, then, as explained more fully below, the flexible support 20 is attached to the support frame 22 with the rigid seat back frame 30 (not shown in FIG. 3) of the seat back disposed therebetween.

The exact shape or form of the seat back frame 30 is not dictated by the invention, and may be on any typically rectangular shape or other shape suitable to accommodate the seat back of a chair. Thus, the lumbar support of this invention may be adapted for use with any conventional chair back.

Figure 4:
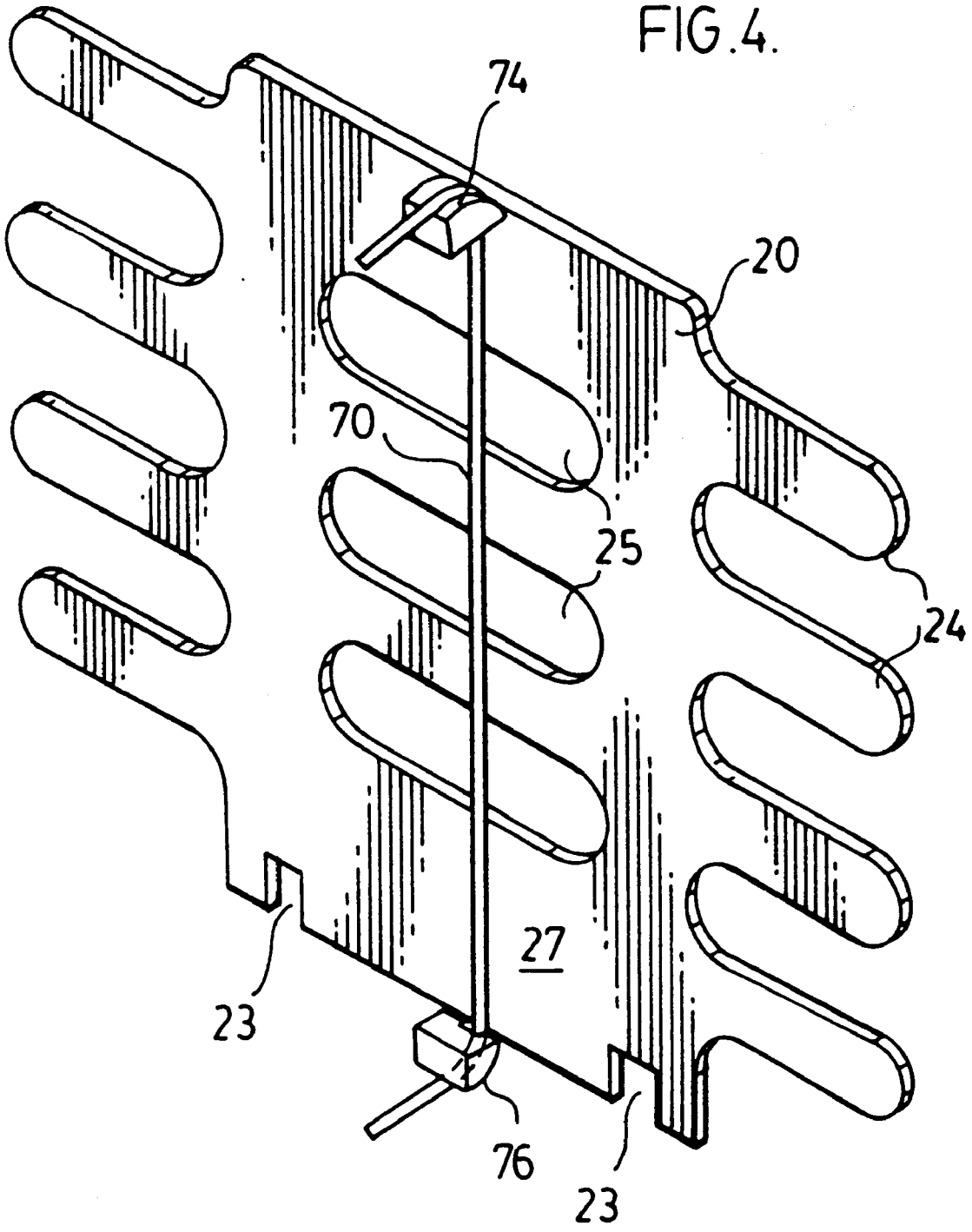
FIG. 4 shows an alternate embodiment of the flexible support member of FIG. 2.

The frames 22 and 30 are preferably made of metal or some other durable, rigid material. For example, frame 22 may be made from plastic and frame 30 may be made from a composite wood material. The flexible support 20 is of a resilient material which will expand outwardly when compressed and, when the compressive force is removed, will at least substantially resume its original shape. Preferably, flexible support 20 is a planar member which is composed of a suitably resilient material such as sheet metal, a plastic or the like so that it may be repeatedly bent without any significant lose of flexibility and also without cracking or otherwise suffering fatigue damage. Preferably, support 20 also has a number of support fingers 24 which extend transversely from the sides 26 of the support 20. The support fingers 24 may be shaped to better accommodate the shape of a human back, as is known in the art. As shown in FIG. 4, the flexible support 20 may also comprise one or more holes or gaps 25 centered about the vertical median of the support so as to improve the support's flexibility in the longitudinal direction.

With reference to FIG. 2, within the seat back frame 30 are a plurality of aligned channels and, preferably, a plurality of pairs of upper and lower vertically extending channels. These channels are openings in seat back frame 30 that are sized and positioned to permit flexible support 20 and rigid frame 22 to move together upwardly or downwardly with respect to seat back frame 30.

Pursuant to the height adjustment mechanism of the preferred embodiment of the invention, frictional engagement may be used to hold the lumbar support at various heights. Accordingly, the track may have first engagement members and the support frame 22 and/or the flexible member 20 may have a second engagement member which releasably engages the first engagement members as the lumbar support member moves longitudinally along the track. The frictional engagement may be provided by an abutment surface provided on the inside of one or more of the channels and/or by an abutment surface provided on the front or the rear face of seat back frame 30. The frictional engagement may be continuous, to permit the infinite adjustment of the lumbar support within the channels, or intermittent, to define a series of preset positions.

For example, in the preferred embodiment shown in the drawings, there is provided a pair of upper vertical aligned channels 32 and 34 and a pair of lower vertical aligned channels 36 and 38. The transverse width of the upper vertical channels 32 and 34 varies between a certain minimum width 64 and a certain maximum width 62 (see FIG. 3) so as to define alternating portions which vary in thickness. The lower channels 36 and 38 may be generally rectangular and may have a fixed transverse width. The seat back frame 30 also contains two other gaps or recesses (or channels) 42 and 44. Gap 42 may be located in the upper median portion of the frame 30, whereas gap 44 may be located in the lower median portion of the frame 30 and vertically aligned with the lower vertical channels 36 and 38.

The support frame 22 may be of any particular shape as long as it provides a rigid support on which flexible support 20 may be mounted. Preferably, as shown in FIGS. 2 and 3, support frame 22 has a U-shape, with a lower base portion 50 and two side portions 52.

Flexible support 20 is mounted on frame 22 to be moveable therewith while still being compressible to bow outwardly. It will be appreciated that at least the top or the bottom of flexible support 20 must be vertically compressible with respect to frame 22 for the amount of lumbar support provided by flexible support 20 to be adjustable. It will also be appreciated that both the top and the bottom of flexible support 20 may be compressible with respect to frame 22.

As shown in FIG. 2, support frame 22 may include forward projecting appendages 63 having hooks 65 for receiving and supporting the slotted out portions 23 at the sides of the bottom end of the flexible support member 20. As hooks 65 are not physically attached to flexible support 20, the lower portion of flexible support 20 may move upwardly to an extend with respect to hooks 65. It will be appreciated that, in an alternate embodiment, the lower portion of flexible support 20 may be affixed to frame 22 in a variety of different manners and may be fixedly attached thereto, eg. by means of screws, glue and the like.

Cable 70 engages the upper portion of flexible support 20 and, due to the tension in cable 70, maintains the upper portion of flexible support 20 in place with respect to frame 30 while leaving flexible support 20 free to bow outwardly when the tension of cable 70 is increased. It will also be appreciated that the upper portion of flexible support may be affixed to frame 22 and that the lower portion may be maintained in place with respect to frame 30 while leaving flexible support free to bow outwardly.

The sides 26 of the flexible support member 20 may be fixed to the top ends 54 of side portions 52 of the support frame 22 means, for example, of anchoring devices 58 (see FIGS. 2–6). The anchoring devices may pass, for example, through the narrow vertical portion 55 which abut the top ends 54 (see FIG. 2). Alternately, anchoring devices 58 may be positioned at any location whereby they pass through a channel in frame 30 so that they will not hinder the vertical movement of flexible member 20. Anchoring devices 58 may comprise screws, but other means for fastening the support 20 to the support frame 22 may also be used. It will be appreciated that by affixing sides 26 to support frame 22, only the central portion of flexible support 20 will bow outwardly to provide lumbar support. If desired, sides 26 may remain unaffixed to support frame 22 thus allowing the sides 26 to bow outwardly with the central portion of flexible support 20 so as to provide a transversely extending lumbar support across the entire width of flexible member 20. It will also be appreciated that a narrow flexible support 20 may be provided to provide only a narrow flexing lumbar support surface thus avoiding the need for anchoring devices 58.

Height adjustment bar 56 comprises a transversely extending member having opposed sides 66 and 68. The sides 66 and 68 extend outwardly from the sides of the seat back portion 16 as illustrated in FIG. 1 and have a handle 67 or other type of manipulation means attached to their ends to facilitate the application of force by a user. Height adjustment bar 56 is affixed to frame 22. For example, the top ends 54 of the side portions 52 of frame 22 may be thicker than the remainder of the side portions and also include a gap (not shown) through which horizontal height adjustment bar 56 is fitted, as illustrated in FIG. 2. The top ends 54 may also be somewhat wider in the transverse direction than the remainder of side portions 52, as best seen in FIG. 3.

In the preferred embodiment, the frictional engagement is provided by runners positioned in the channels in frame 30. Engagement members 60, which may be cylindrical plugs or other suitable devices, are inserted, for example, through the top ends 54 of the support frame 22 and through horizontal height adjustment bar 56 into the vertical channels 32 and 34 respectively to act as runners in the channels. Referring to FIG. 3, engagement members 60 are of a size and shape (preferably cylindrical) such that they move freely within portions 62 of the vertical channels 32 and 34 having a relatively larger width and they are statically immoveable within portions 64 of the vertical channels 32 and 34 having a relatively smaller width to define a series of preset positions. The term statically immoveable is intended to indicate that the engagement members 60 will not move until a force at or above a certain threshold has been applied to them. This prevents the lumbar support from being accidentally moved once the user places the lumbar support in a desired position.

It will be appreciated that height adjustment bar need not be horizontal but may be of any particular configuration that can transmit a vertical (i.e. upward or downward) force from a position adjacent the side of seat back 16 to frame 22.

Thus the height of the flexible support member 20, which is mounted on support frame 22, may be adjusted by applying a sufficient amount of force either upwardly or downwardly at one handle 67 on one of the sides 66 and 68 of the horizontal height adjustment bar 56. The engagement members may thereby be moved from one portion of the channels 32 and 34 in which they are statically immoveable to another portion in which they are also statically immoveable. Referring to FIG. 2, as the engagement members 60 travel up and down the vertical channels 32 and 34, the forward projecting appendages 62 at the sides of the base portion 50 of the support frame 22 simultaneously and correspondingly travel up and down the vertical channels 36 and 38 in the seat back frame 30.

Channels 32, 34, 36 and 38 define a vertical track along which flexible support 20 may travel. Each channel is positioned to provide a track adjacent one of the corners of flexible support 20 thereby preventing, or minimizing, transverse motion of flexible member 20 as it travels upwardly or downwardly. It should be noted that although a preferred embodiment of the present invention uses an upper pair of channels (32 and 34) and a lower pair of channels (36 and 38), a differing or the same number of channels positioned at differing or the same locations may be used.

It will be appreciated that narrow portions 55 may be provided to act as stops to engage the upper and lower surfaces of the channels. In another embodiment, engagement members 60 may act as the stops.

An advantage of the instant invention is that the height adjustment of the lumbar support may be easily actuated while the user is seated in the chair. By mounting frame 22 so that it rides on a track (eg. The channels), the user need only grasp one handle 67 to apply the requisite force to height adjustment bar 56 to adjust the height of the lumbar support. It will be appreciated that height adjustment bar may only extend transversely outwardly of one side of seat back 16. However, it is preferred that adjustment bar extends transversely outwardly of both sides of seat back 16 so that the height of the lumbar support may be easily adjusted by both a right handed and a left handed person.

Figure 9:
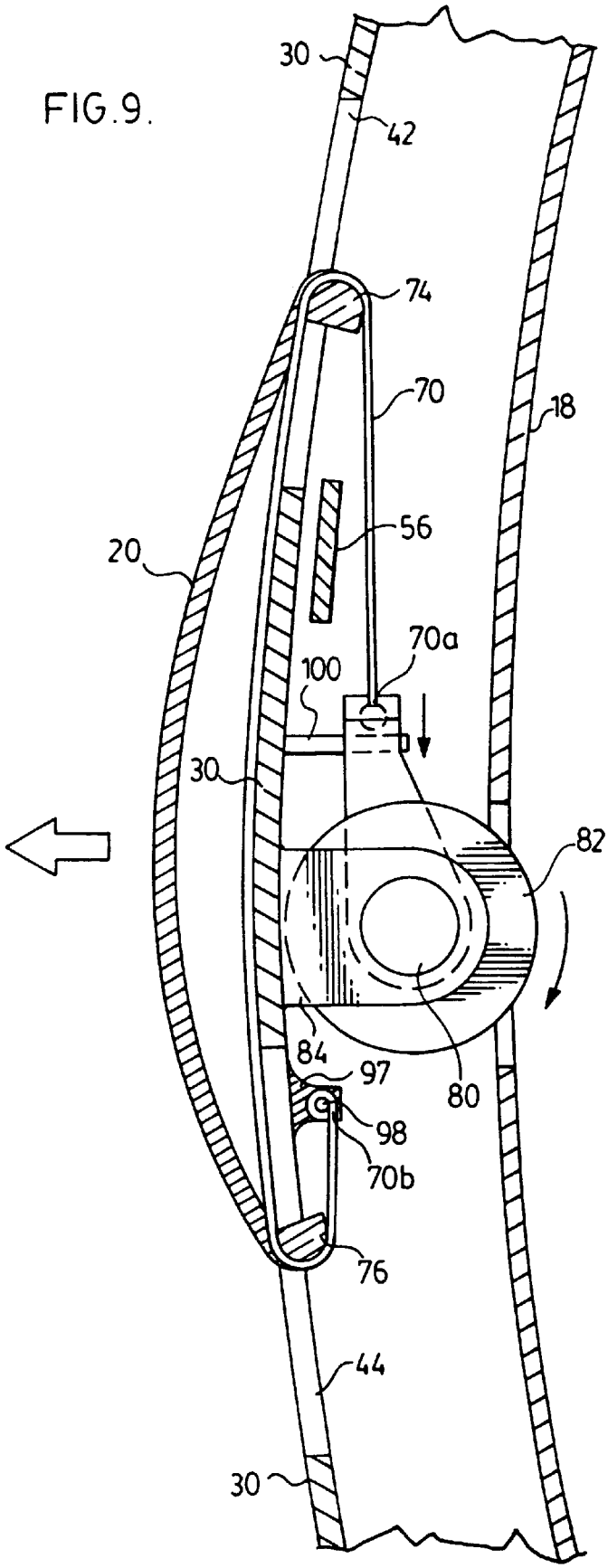
FIG. 9 illustrates the forward adjustment of the lumbar support member of the present invention.

The amount of lumbar support provided by flexible support 20 is adjusted by applying a compressive force to the upper and lower portions of flexible support 20. In the preferred embodiment, the compressive force is provided by a cable or other tension element 70 having a first end **70*a* and a second end 70*b*. Cable 70 engages the upper and lower ends of the flexible support 20 and extends either along the rear surface 27 of flexible support 20 (eg. when the flexible support is in the relaxed, flat state as shown in FIG. 6) or rearwardly of the flexible support (eg. when flexible support is under tension as is shown in FIG. 9) whereby the flexible support bows forwarding in the direction of the arrow shown in FIG. 9 when compressed by cable 70**.

As best illustrated in the cross-sectional view of FIG. 6, the median portion of the top edge of the flexible support 20 has a bearing member 74 which has an opening so that cable 70 may pass freely therethrough. Similarly, the median portion of the bottom edge of the flexible support 20 has a bearing member 76 which has an opening so that cable 70 may pass freely therethrough.

The cable 70 and bearing members 74 and 76 respectively, pass through the holes or gaps 42 and 44 in the seat back frame 30 which are vertically elongated as shown in FIG. 2 to accommodate variations in the height of the flexible support member 20. By increasing the tension of the cable or tension element 70, flexible support 20 is compressed and the vertically extending median portion of the flexible support member is arched or bowed forwardly (i.e. convexly) to provide lumbar support at varying horizontal positions and independently of height adjustment. As will be appreciated, cable 70 is preferably affixed to frame 30 so that the ends of cable 70 do not travel when flexible support 20 is adjusted vertically. Since cable 70 is free floating on bearing members 74 and 76, the forward bowing of flexible support 20 is not affected by the vertical movement of flexible support 20. It will be appreciated that cable 70 may be affixed to frame 22.

The amount of lumbar support may be varied by adjusting the length of cable 70. As the vertical travel of cable 70 is shortened, a compressive force is applied to the upper and lower portions of flexible support 20 thus causing flexible support to bow outwardly. Cable 70 may be shortened by winding cable 70 onto a spindle or the like. However, in order to reduce the force which must be applied to shorten cable 70, in the preferred embodiment, the vertical travel is shortened by transversely moving one end of cable 70.

Figure 7:
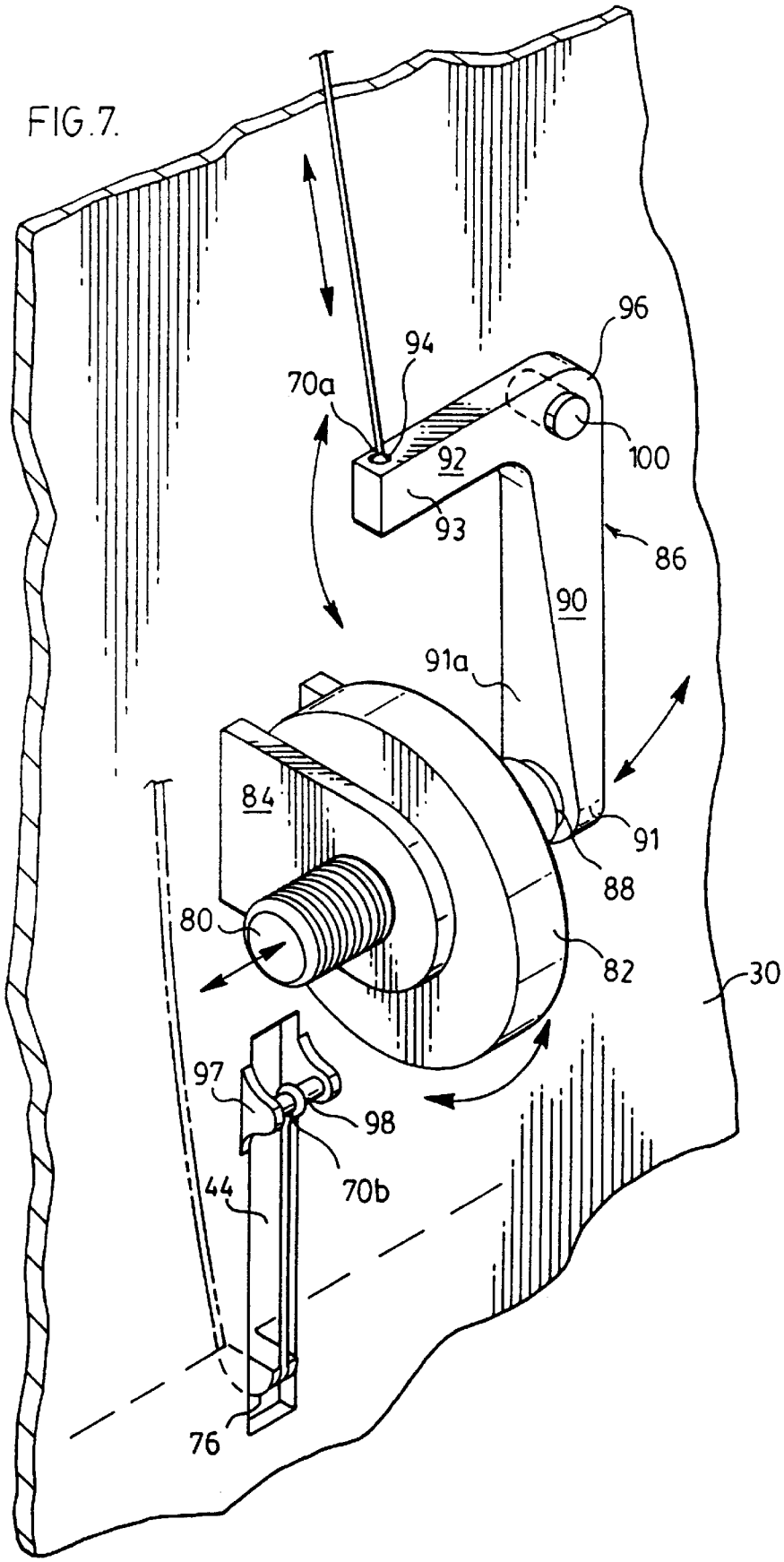
FIG. 7 shows a detailed view of the tension adjustment mechanism.

FIG. 7 best illustrates a preferred embodiment of a means for adjusting the tension of the cable 70 to compress flexible support 20. A pair of attachment members 84 having openings (not shown) extend rearwardly from frame 30. A horizontal threaded shaft 80 having an abutment face 88 extends through the openings in attachment members 84. The openings are sufficiently large that threaded shaft 80 is rotatably mounted on attachment members 84. A rotatable hand-actuated knob 82 is threadedly mounted to the shaft 80 between attachment members 84. As hand actuated knob 82 is fixed in position between the pair of attachment members 84, rotation of knob 82 causes threaded shaft to move transversely. As knob 82 rotates in one direction, causing threaded shaft to rotate about its longitudinal axis, it moves transversely to the left when rotated in one direction and transversely to the right when rotated in the other direction.

Lever 86 is pivotally mounted to seat back frame 30 by any means known in the art. As shown in FIG. 7, lever 86 comprises first arm 90, second arm 92 and a base or fulcrum portion 96. Fulcrum 96 is pivotally attached to the seat back frame 30 by pivot mount 100. Arms 90 and 92 of the lever 86 are joined to fulcrum portion 96 of the lever, about which the lever (and the arms) pivot and rotate. Arm 90 has an end 91 distal to fulcrum 96 and arm 92 has an end 93 distal to fulcrum 96.

Abutment face 88 of the shaft 80 abuts face 91*a* and 91 of first arm 90. Second arm 92 includes at or near end 93 means 94 for receiving and retaining therein end 70*a* of the cable 70. End 70*a* may be secured therein by any means known in the art such as by using a set screw or by providing an opening in end 93 through which cable 70 extends and providing end 70*a* with an enlarged stop (not shown).

End 70*b* of the cable 70 is fixedly attached to seat back frame 30. Therefore, as the position of end 70*a* of cable 70 is adjusted, the effective (or vertical) length of cable 70 is adjusted. End 70*b* may be affixed to seat back frame 30 by any means known in the art. For example, bracket 97 may be mounted to the rear face of seat back frame 30 with a rod 98 extending therebetween. End 70*b* may be provided with a loop through which rod 98 extends.

As shown in FIGS. 1 and 6, the back cover 18 of the seat back portion 16 contains a gap or hole through which the hand-actuated knob 82 protrudes for ease of manipulation by a user. In operation, as the knob 82 is rotated, the shaft 80 moves horizontally in a transverse direction. As shown for example in FIG. 3, as the shaft moves to the right, this forces the arms 90 and 92 of the lever 86 to rotate in a counterclockwise direction. Since cable 70 is effectively inelastic, as arm 90 moves to the right, the vertical distance travelled by cable 70 from end 70*b* to end 70*a* decreases. Thus cable 70 applies a compressive force to flexible support 20. Conversely, as the shaft 80 moves to the left, the arms 90 and 92 rotate about the fulcrum 96 in a clockwise direction and thereby allow the vertical distance travelled by cable 70 to increase. In this manner, the convex curvature of the vertical median of the flexible support member 20 can be adjusted to accommodate the lumbar support requirements of a particular seat user. The greater the rightward displacement of arm 90, the more bowed or curved is the vertical median of the flexible support member 20.

Figure 8:
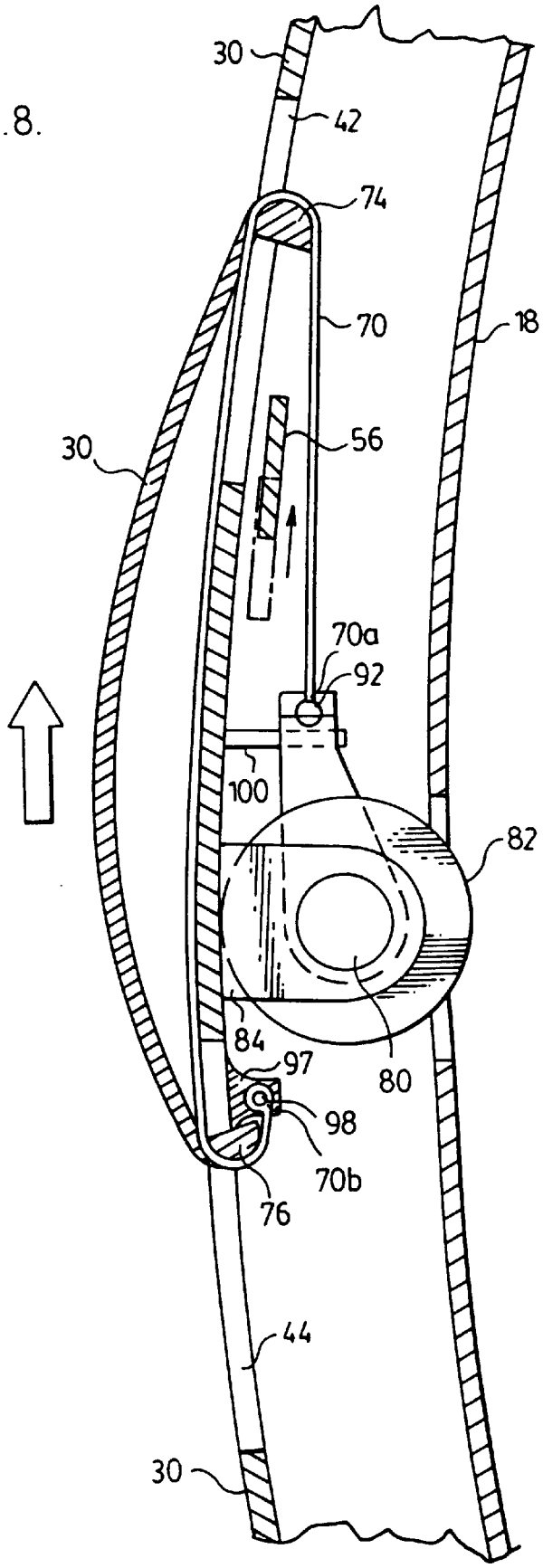
FIG. 8 illustrates the vertical adjustment feature of the present invention.

The present invention thereby independently provides both vertical adjustment of the support member 20 as illustrated in FIG. 8 and bowing adjustment of the vertical median of the support member as illustrated in FIG. 9. FIGS. 3 and 6 respectively illustrate the position of the tension adjustment mechanism and the bowing of the flexible support member 20 and when the cable is under low tension. FIG. 9, on the other hand, illustrates the bowing of the vertical median of the flexible support member under a greater amount of tension.

Because the tension adjustment mechanism for cable 70 is fixed with respect to the seat back frame 30, the tension adjustment mechanism does not change position when the height of the flexible support member 20 is adjusted. This is illustrated in FIG. 8. Thus, as the height of flexible support 20 is adjusted, cable 70 slides around bearing members 74 and 76. As a result, it is unnecessary to create and elongated vertical gap in the back cover 18 of the seat back portion of the seat to accommodate for the protrusion of the hand-actuated knob 82.

Due to the independent nature of the two adjustment mechanisms, it will be appreciated that if the lumbar support in seat back 16 is not height adjustable, frame 30 need not be sandwiched between flexible support 20 and support frame 22. In fact, in such an embodiment, frame 30 may function as support frame 22. It will also be appreciated that, in another embodiment, a non-adjustable lumbar support member, or an alternate means of adjusting the amount of lumbar support which is provided by the lumbar support member, may be used in conjunction with the height adjustment member disclosed herein.

While preferred embodiments of the present invention have been described, the embodiments disclosed are illustrative and not restrictive, and the scope of the invention is intended to be defined only by the appended claims.

We claim:

1. A chair back for mounting to an office chair having a seat, the chair back comprising:

(a) a rear surface, a front surface spaced from the rear surface and a side extending between the front and rear surfaces;

(b) a lumbar support member movably mounted between the front and rear surfaces on a track for vertical movement of said lumbar support member with respect to the chair back and for forward longitudinal movement with respect to the chair back, the lumbar support member has a runner which travels in the track, the track being provided on a frame and having alternating portions which vary in width, a plurality of the portions of the track having a width less than the thickness of the runner to frictionally engage the runner to hold the lumbar support member in position with respect to the chair back and a plurality of the portions of the track having a width greater than the thickness of the runner to permit the runner to travel freely therein;

(c) a first control member operatively connected to the lumbar support member for adjusting the forward movement of the lumbar support member; and (d) a second control member operatively connected to the lumbar support member for adjusting the vertical height of the lumbar support member relative to the front surface, the first control member remaining at a fixed position with respect to the rear surface when the vertical height of the lumbar support member is adjusted.

2. A chair back for mounting to an office chair having a seat, the chair back comprising:

(a) a rear surface, a front surface spaced from the rear surface and a side extending between the front and rear surfaces;

(b) a lumbar support member movably mounted between the front and rear surfaces of a rigid frame for vertical movement of said lumbar support member with respect to the chair back and for forward movement with respect to the front surface, the lumbar support member comprising a flexible panel, a flexible member, a frame member and an arm member, the flexible panel having an upper end and a lower end, one of the upper and lower ends mounted to be vertically fixed in position with respect to the frame member, the flexible member contacting the other of the upper and lower ends of the flexible panel and extending rearwardly of the flexible panel whereby the flexible bows forwardly when compressed by the flexible member, the arm member having first and second arms, the arm member pivotally mounted on the rigid frame;

(c) a first control member drivingly engaging the first arm and the second arm being drivingly connected to the flexible member, the first control member including a lumbar adjustment member mounted for transverse movement whereby transverse movement of the lumbar adjustment member in one direction causes the first arm to move transversely and the second arm to move vertically to compress and bow the flexible panel; and (d) a second control member operatively connected to the lumbar support member for adjusting the vertical height of the lumbar support member.

3. The chair back as claimed in claim 2 wherein the first control member comprises a threaded member rotatably mounted on the rigid support member and a rotatable control knob rotatably mounted on the threaded member.

4. A chair back for mounting to an office chair having a seat, the chair back comprising:

(a) a rear surface, a front surface spaced from the rear surface and a side extending between the front and rear surfaces;

(b) a rigid support member;

(c) a lumbar support member movably mounted between the front and rear surfaces to a frame for vertical movement of said lumbar support member with respect to the chair back and for forward movement with respect to the front surface, the lumbar support member comprising a flexible panel, a flexible member connected to said flexible panel and a threaded shaft rotatably mounted on the rigid support member for movement in the transverse direction about its longitudinal axis, a rotatable knob operable to move the shaft in the transverse direction, a pivoting member pivotally mounted to the rigid support member and having a first arm having a first end which abuts one end of the threaded shaft and a second arm having a first member for receiving the first end of the flexible member, and the lower end of the flexible panel has a second member for receiving the second end of the flexible member;

(d) a first control member operatively connected to the lumbar support member for adjusting the forward movement of the lumbar support member; and, (e) a second control member operatively connected to the lumbar support member for adjusting the vertical height of the lumbar support member.

5. A chair back for mounting to an office chair having a seat, the chair back comprising:

(a) a rear surface, a front surface spaced from the rear surface and a side extending between the front and rear surfaces;

(b) a lumbar support member movably mounted between the front and rear surfaces to a frame for vertical movement of said lumbar support member with respect to the chair back and for forward movement with respect to the front surface, the lumbar support member comprising a flexible panel having first engagement members and a rigid member having second engagement members, the frame having a plurality of openings, the first and second engagement members passing through the openings to engage and fix the flexible panel in position with respect to the rigid member;

(c) a first control member operatively connected to the lumbar support member for adjusting the forward movement of the lumbar support member; and, (d) a second control member operatively connected to the lumbar support member for adjusting the vertical height of the lumbar support member.

6. The chair back as claimed in claim 5 further comprising first and second attachment members for fixedly attaching each transverse side of the flexible panel to the respective side of the rigid member, the first and second attachment members passing through the openings in the frame whereby the transverse sides of the flexible panel are fixed in position with respect to the rigid member and the portion of the flexible panel between the transverse sides of the flexible panel is free to bow forwardly.

* * * * *